United States Patent [19]

Blickley et al.

[11] 4,291,844

[45] Sep. 29, 1981

[54] SHAFTLESS REWIND CHUCK

[75] Inventors: Michael Blickley, Manville; Nicholas G. Naccara, Hewitt, both of N.J.

[73] Assignee: Midland-Ross Corporation, Cleveland, Ohio

[21] Appl. No.: 144,443

[22] Filed: Apr. 28, 1980

[51] Int. Cl.[3] ..... B65H 75/24

[52] U.S. Cl. ..... 242/68.2; 242/68.4

[58] Field of Search ..... 242/68.4, 68.3, 68.2, 242/68.1, 68, 72 R, 46.2, 46.6; 279/2 R; 269/48.1; 82/44

[56] References Cited

U.S. PATENT DOCUMENTS

| | | | |
|---|---|---|---|
| 1,882,950 | 10/1932 | Rulon | 242/46.2 |
| 1,985,026 | 12/1934 | Epps | 242/46.2 X |
| 3,224,701 | 12/1965 | Wynne | 242/68.1 |
| 3,731,885 | 5/1973 | Siebert | 242/68.3 |
| 3,837,591 | 9/1974 | Clarke | 242/68.2 X |
| 4,084,762 | 4/1978 | Repp | 242/68.3 |

*Primary Examiner*—John M. Jillions

*Attorney, Agent, or Firm*—Harlan E. Hummer

[57] ABSTRACT

A chuck is described for use with another similar chuck to hold a hollow cardboard tube on which a web, such as plastic film, is spirally wound after it has been slit into a desired width on a slitting and rewinding machine. The chuck has a plurality of sears which are positioned within specially shaped slots that are recessed in the chuck. Each sear is generally L-shaped and has a first leg for engaging the open end of the tube and a second leg for engaging and gripping the inner periphery of the tube, as the open end of the tube engages the first leg and causes it to move and rock the sear in the slot.

11 Claims, 5 Drawing Figures

Fig. 1
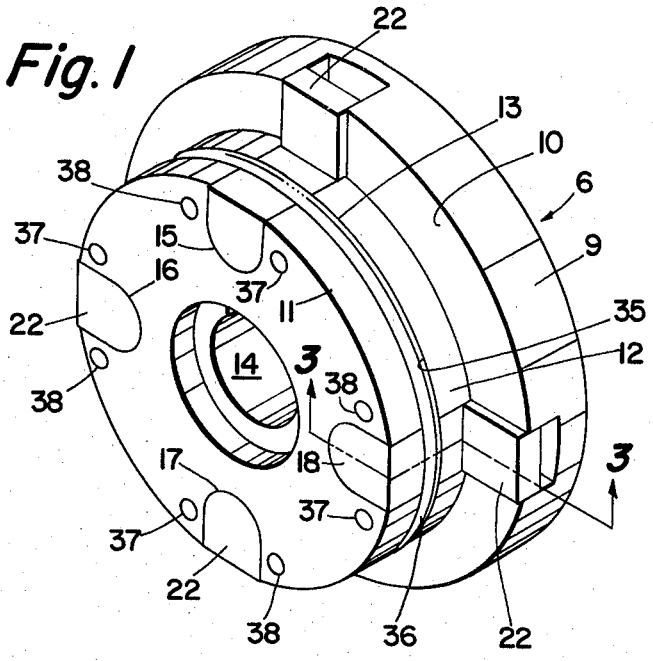
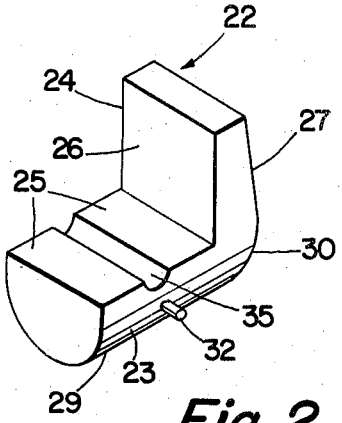
Fig. 2
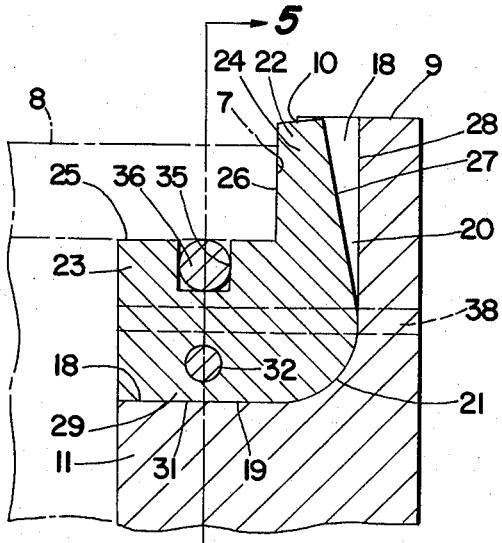
Fig. 3
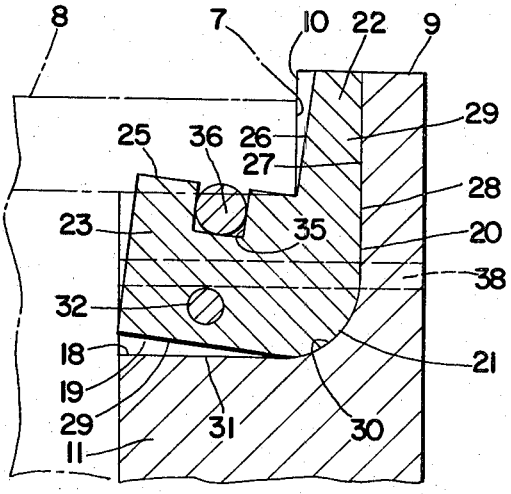
Fig. 4
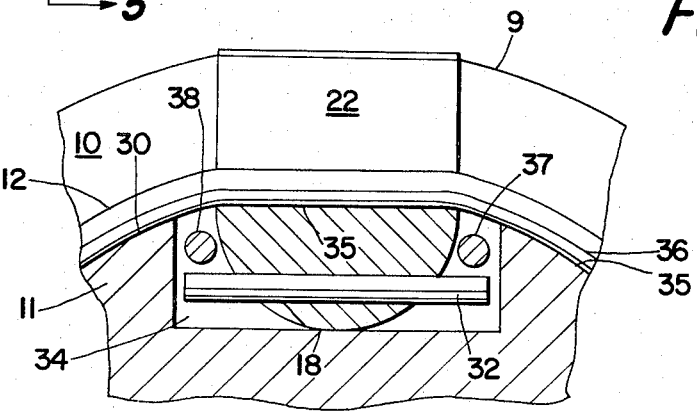
Fig. 5

SHAFTLESS REWIND CHUCK

BACKGROUND OF THE INVENTION

The invention relates to chucks and, more particularly, to a chuck on which is mounted a cardboard core or tube on which a web, such as plastic film, is spirally wound after the web has been slit into an appropriate width on a combination slitting and rewinding machine. It is difficult to provide a chuck which firmly holds such a cardboard tube at high rotational speeds without slippage and without severely damaging the tube. The invention is directed to a novel chuck which is simple in design and, therefore, economical to build, and which is highly effective in overcoming the aforemention problems.

Briefly stated, the invention is in a chuck for engaging and holding the open end of a hollow core or tube on which a web of material is spirally wound. The chuck comprises a cylindrical flange having an integrally formed outstanding smaller diameter cylindrical hub which extends outwardly from the flange and is designed to be received in the open end of the tube. The hub and flange are provided with a plurality of L-shaped arcuately spaced slots which are radially oriented relative to the longitudinal axis of the hub. A sear is disposed in each of the slots and is specially shaped to rock therein in a radial plane relative to the longitudinal axis of the hub. Each sear is generally L-shaped and has a pair of legs which are angularly disposed to each other, the first of the pair of legs resting in the portion of the slot formed in the hub and the second of the pair of legs resting in the portion of the slot formed in the flange. Each sear is shaped so that the first leg will be free of contact with a hollow tube mounted on the chuck in surrounding relation to the hub, when the tube does not engage the second leg, and the first leg will be correspondingly moved into engagement with the inner periphery of the hollow tube surrounding the hub, as the tube engages and moves the second leg in the direction of the flange sufficiently to cause the sear to rock. Any suitable means are provided for retaining the sears in the slots during rotation of the chuck.

U.S. Pat. No. 1,882,950 shows and describes a chuck which employs differently shaped sears that are positioned in slots found only in the hub and which are designed to engage only the inner periphery of a hollow tube as it is mounted on the chuck. The sears, shown in this patent, are typically long and necessitate the use of a lengthy hub which minimizes the length and number of tubes that can be placed, for example, on a slitting and rewinding machine wherein the tubes are individually mounted between a pair of chucks which, in turn, are fastened to a pair of stubbed shafts at the free outer ends of a pair of rewind arms that are normally mounted on a common support shaft. The stubbed shafts and attached chucks, carried by each pair of rewind arms, are movable laterally to and from each other to accommodate mounting of the tubes on the machine. The amount of lateral movement of the chucks affects the length and number of tubes that can be mounted on a machine and is naturally dependent upon the shape of the sears and the corresponding length of the hubs which house the sears. It can be appreciated from the above that the number and length of the tubes are maximized by the use of short sears and hubs. This is a big advantage of the invention which is in a chuck that utilizes specially shaped sears which are compact and require minimum length hubs, but which are highly effective in preventing slippage of the tubes on the chucks at high rotational speeds.

DESCRIPTION OF THE DRAWING

The following description of the invention will be better understood by having reference to the accompanying drawing, wherein:

FIG. 1 is a perspective view of a chuck which is made in accordance with the invention;

FIG. 2 is a perspective view of a sear which is part of the chuck;

FIG. 3 is a section of the chuck, as viewed from the line 3—3 of FIG. 1, and is designed to show the position of the sear when a hollow core or tube, illustrated in dotted line, is first positioned around the hub of the chuck;

FIG. 4 is a section, similar to that of FIG. 3, and is designed to show the position of the sear, when the hollow tube is fully seated on the chuck for rotation; and FIG. 5 is a section of the chuck, as viewed from the line 5—5 of FIG. 3.

DESCRIPTION OF THE INVENTION

With reference to the drawing, there is shown a chuck 6 which is used with another identical chuck for gripping and holding the opposing open ends, e.g. end 7, of a hollow cardboard core or tube 8 on which, for example, a plastic sheet or film is spirally wound. Each chuck 6 comprises a cylindrical flange 9, having an annular planar surface 10, and a cylindrical hub 11 which is integral and coaxially aligned with the flange 9, and which extends outwardly from the annular surface 10 of the flange 9. The hub 11 has a smaller outside diameter than the flange 9 and an outer circumferential surface 12 which has an annular groove 13 circumferentially recessed therein. The hub 11 is provided with a center opening or bore 14 which, for example, is designed to receive a short drive shaft to which the chuck 10 is keyed for unitary rotation. The chuck 6 is provided with a plurality of slots 15–18 which are recessed inwardly of the hub 11 and flange 9 and radially oriented relative to the longitudinal axis of the hub 11. Each of the slots 15–18, as best seen in FIG. 3, is generally L-shaped and has a body portion 19 which is located mainly in the hub 11 and circumferential surface 12 thereof, and an upstanding top portion 20 which is located mainly in the flange 9 and annular surface 10 thereof. The body portion 19 has a generally concave cross-section relative to the longitudinal axis of the hub 11, whereas the top portion 20 has a rectangular cross-section. A curved inside corner portion 21, extending from the flange 9 slightly into the hub 11, connects the body portion 19 with the top portion 20.

A generally L-shaped sear 22 is positioned in each of the slots 15–18 to firmly grasp an adjacent open end of the tube 8, when the tube is properly mounted between a pair of chucks 6, to keep the tube from slipping on the chucks 6 at high rotational speeds. Each of the sears 22 comprises a pair of legs 23,24. The first leg or main body 23 of each sear 22, has a cross-section which is convex and matingly configured for seating engagement in the body portion 19 of each of the slots 15–18, when the sears 22 are in their rest positions within the slots out of gripping engagement with a hollow tube, as seen in FIG. 3. In this position, the first leg 23 has a flat outer surface or stop 25 which is generally flush with the outer circumferential surface 12 of the hub 11. The second leg 24 of each sear 22 has a rectangular cross-section which decreases, in area, the farther the section is taken from the first leg 23, because the second leg 24 has a flat front or abutment 26 and a backside 27 which converge towards each other in a direction away from the first leg 23. The backside 27 of the second leg 24 diverges in the same direction from an adjacent backwall 28 of the top slot portion 20 of the flange 9, when the sears 22 are in their rest positions, because, the frontside 26 of each sear 22 is generally parallel to the planes of the flange 9 and the adjacent backwall 28 of the slot in which the sear is seated. The flat backside 27 of each sear 22 is joined to an adjacent, transversely curved bottomside 29 thereof by a rounded corner 30 which is designed for matingly seated engagement with the curved inside corner portions 21 of the slots 15–18.

It can be appreciated from FIG. 3, that the included angle between intersecting planes containing the bottomside 29 and backside 27 of each sear 22 is less than the included angle between intersecting planes containing the backwall 28 and lowermost line 31 of the body portion 19 of the slots 15–18, so that the sears 22 can be rocked within the slots 15–18, depending on which of the legs 23,24, is moved by the application of a force thereagainst. The included angle between intersecting planes containing the flat stop 25 and abutment 26 of each sear is also generally 90°. The stop 25 of each sear 22, when in the rest position of FIG. 3, is generally flush with the adjacent outer circumferential surface 12 of the hub 11, whereas the flat abutment 26 protrudes outwardly of the flange 9 in generally parallel relation to the annular surface 10 thereof.

Each of the sears 22 is provided with a rollpin 32 which extends transversely through the first leg or body 23 into a pair of wing-like slot extensions 33,34 which extend laterally from each of the body portions 19 of the slots 15–18 in the hub 11. Each rollpin 32, as best seen in FIG. 3, is substantially aligned with a groove 35 which is recessed transversely in the flat stop 25 of the first leg 23. The grooves 35 in the sears 22 are designed to be in alignment with the annular groove 13 in the outer circumferential surface 12 of the hub 11, when the sears 22 are in their rest positions. An elastic O-ring 36 is placed in the grooves 13,35 of the hub 11 and sears 22 to hold the sears 22 in their rest positions in the slots 15–18 to permit unhampered insertion of a tube around the hub of a chuck. To insure that the sears do not leave the slots 15–18 during high rotational speeds of the chuck 10, each of the slots 15–18 is provided with a pair of retainer pins 37,38 which are designed to engage and hold within the slot extensions 33,34, a rollpin 32 of a sear that is attempting to escape from the slot in which it is positioned. A pair of retainer pins 37,38 extend longitudinally into the hub 11 on either side of each of the slots 15–18 in parallel relation to the longitudinal axis of the hub 11, and, as best seen in FIGS. 3 and 4, extend through the slot extensions 33,34 between the rollpins 32 and annular groove 13 in the hub 11, to bar movement of the rollpins 32 and attached sears out of the slots 15–18.

In operation, the stubbed shafts and attached pair of chucks 6 carried, for example, by a pair of rewind arms, are moved laterally apart to receive a hollow cardboard tube. The chucks are then moved together toward their normal operating positions where the hubs 11 of the chucks 6 are completely within the open ends of the tube. The open ends of the tube engage the abutments 26, as the chucks 6 are forced together, to move the second legs 24 of the sears 22 inwardly of the flanges 9 from the positions of FIG. 3 to the positions of FIG. 4, where the open ends of the tube abut the annular surfaces 10 of the flanges 9. The second legs 24, as they move towards the flanges 8, cause corresponding radial movement of the first legs 23, and stops 25 carried thereby, from the hub 11 into compressive engagement with the inner periphery of the tube adjacent the open tube ends at a number of arcuately spaced spots surfficient to firmly hold the tube for rotation at high speeds without slippage on the chucks 6 and without critically damaging the tubes so that they can be reused in another winding operation. The chucks 6 and attached tube are conventionally rotated to spirally wind a continuous web around the tube to which the end of the web is attached.

Thus, there has been described a highly improved chuck which is simply designed and economical to manufacture, and which provides adequate force for firmly gripping and holding a core or tube at high rotational speeds. The sears are small and compact and are designed to rock about their rounded corners, although a pivot could be provided at this point, but this would complicate the design of the sear and, therefore, not be as desireable. It can be imagined that there may be some sliding of the sears within the slots even though the sears are primarily designed to rock and not slide or pivot between the positions of FIGS. 3 and 4. The shape of the sears are such that the length of the hub of each chuck is minimized to maximize the length and number of tubes that can be used, for example, on a slitting and rewinding machine.

What is claimed is:

1. A chuck for engaging and holding the open end of a hollow tube on which a web of material is spirally wound, comprising:

(a) a cylindrical hub extending coaxially from a cylindrical flange which has a larger inside diameter than the hub;

(b) a plurality of slots arcuately spaced in the hub and flange, the slots being radially oriented relative to the longitudinal axis of the hub, each of the slots having a pair of surfaces wherein the included angle between a pair of intersecting planes containing at least portions of said surfaces is substantially 90°;

(c) a sear disposed in each of the spots and shaped to rock therein in a radial plane relative to the longitudinal axis of the hub, each sear comprising a pair of legs which are angularly disposed to each other and joined for unitary movement, the first of the pair of legs resting in a portion of the slot mainly in the hub and the second of the pair of legs resting in a portion of the slot mainly in the flange, each slot and sear therein being shaped so that, firstly, the first leg is free of contact with a hollow tube surrounding the hub, when the tube is free of engagement with the second leg, and, secondly, the first leg correspondingly moves into tighter engagement with the inner periphery of a hollow tube surrounding the hub, as the tube engages and moves the second leg in the direction of the flange sufficient to rock the sear and, each of the sears having a pair of matingly configured surfaces wherein the included angle between a pair of intersecting planes containing at least portions of said surfaces of the sear is less than 90°, so that said surfaces of the sears will alternately engage matingly configured surfaces of the slots; and (d) means for retaining the sears in the slots during rotation of the chuck.

2. The chuck of claim 1, wherein the retaining means includes an elastic O-ring which is positioned in a circumferential groove that is formed in the hub and an aligned groove that is formed cross-wise in the first leg of each of the sears.

3. The chuck of claim 1, wherein the first leg of each sear has a flat surface which is flush with the outer circumferential surface of the cylindrical hub, when the sear is in a rest position out of engagement with a hollow tube, and the second leg has a flat surface which protrudes outwardly of the slot and adjacent surface of the flange, when the sear is in a rest position.

4. The chuck of claim 3, wherein the flat surface of the first leg acts as a stop which engages and grips the inner periphery of the tube, and the flat surface of the second leg acts as an abutment which engages the tube when the tube is pushed onto the chuck in the direction of the flange.

5. A chuck for engaging and holding the open end of a hollow tube on which a web of material is spirally wound, comprising:

(a) a cylindrical hub extending coaxially from a cylindrical flange which has a larger outside diameter than the hub;

(b) a plurality of slots arcuately spaced in the hub and flange, the slots being radially oriented relative to the longitudinal axis of the hub;

(c) a sear disposed in each of the slots and shaped to rock therein in a radial plane relative to the longitudinal axis of the hub, each sear comprising a pair of legs which are angularly disposed to each other and joined for unitary movement, the first of the pair of legs resting in a portion of the slot mainly in the hub and the second of the pair of legs resting in a portion of the slot mainly in the flange, each slot and sear therein being shaped so that, firstly, the first leg is free of contact with a hollow tube surrounding the leg, when the tube is free of engagement with the second leg, and, secondly, the first leg correspondingly moves into tighter engagement with the inner periphery of a hollow tube surrounding the hub, as the tube engages and moves the second leg in the direction of the flange sufficient to rock the sear; and (d) means for retaining the sears in the slots during rotation of the chuck, the retaining means including an elastic O-ring which is positioned in a circumferential groove which is formed in the hub and an aligned groove that is formed cross-wise in the first leg of each of the sears, the retainer means further including a rollpin extending transversely through the first leg of each sear into adjacent wing-like lateral extensions of each of the slots and, secondly, a plurality of retaining pins extending longitudinally in the hub through the wing-like lateral extensions for coacting with opposing ends of the rollpin of each sear to restrict radial movement of the sears outwardly of the slots.

6. A chuck for engaging and holding an adjacent open end of a hollow tube, comprising:

(a) a cylindrical flange having an outstanding cylindrical hub extending therefrom for insertion into a hollow open end of a tube, the outside diameter of the hub being less than the outside diameter of the flange and the inside diameter of the tube;

(b) first means movable from the hub in a generally radial direction, relative to the longitudinal axis of the hub, to grip the inner periphery of the open end of the tube at at least one location, the first means including a flat stop lying in a plane which is angularly disposed to the plane of the flange;

(c) second means movable into the flange upon engagement with the open end of the tube, when the tube is inserted over the hub to a point where the tube engages the flange, the second means being movable in a generally longitudinal direction relative to the longitudinal axis of the hub, and causing corresponding radial movement of the first means, relative to said longitudinal axis, the second means including a flat abutment lying in a plane which is angularly disposed to the longitudinal axis of the hub;

(d) a third means connecting the stop and abutment for unitary movement, but in opposite directions in relation to movement for contacting the tube;

(e) a plurality of generally L-shaped slots disposed in the hub and flange and equally arcuately spaced about the longitudinal axis of the hub and flange;

(f) the first, second and third means including:

(I) a generally L-shaped sear matingly configured to rest in each of the slots, each sear comprising a pair of legs, the first of which pair of legs rests in the hub and carries a stop for engaging the inner periphery of the tube, and the second of which pair of legs rests in the flange and carries an abutment for engaging the open end of the tube; and (g) means for retaining the sears in the slots, including:

(I) a rollpin extending through the first leg of each sear into wing-like lateral extensions of the slots in which the sears rest; and (II) a pair of retainer pins extending longitudinally through the hub on either side of each slot therein, the retainer pins extending through the wing-like lateral slot extensions between the rollpins and outer circumferential surface of the hub.

7. The chuck of claim 6, wherein the retaining means includes:

(III) a circumferential groove recessed in the outer circumferential surface of the hub; and (IV) a resilient O-ring positioned in the groove and extending transversely across each of the sears in the slots.

8. The chuck of claim 7, wherein each of the L-shaped slots include:

(I) a slot portion in the hub having a generally concave cross-section relative to the longitudinal axis of the hub;

(II) a slot portion in the flange having a generally rectangular cross-section; and (III) a curved inner corner connecting the slot portions; and each of the sears include:

(IV) a first leg having a convex cross-section relative to the longitudinal axis of the hub;

(V) a second leg having a rectangular cross-section; and (VI) a rounded outside corner connecting the first and second legs and matingly rounded to rest against the curved inner corner of a slot.

9. The chuck of claim 8, wherein the second leg has an outer free end which is spaced from the adjacent slot portion in the flange, when the first leg, along the length thereof, is in contact with an adjacent surface forming a portion of the slot in the hub.

10. A chuck for engaging and holding the open end of a hollow tube on which a web of material is spirally wound, comprising:

(a) a cylindrical hub and flange in coaxial alignment with concentric outer peripheries, the flange having an outside diameter which is larger than the outside diameter of the hub;

(b) a plurality of L-shaped slots disposed in the hub and flange and arcuately spaced therearound, the slots extending from the outer peripheries inwardly of the hub and flange and being radially oriented relative to the longitudinal axis of the hub and flange, each of the slots having a pair of surfaces with an inside rounded corner therebetween;

(c) a generally L-shaped sear disposed in each of the slots and shaped to rock therein, each of the sears having a pair of surfaces with an outside rounded corner therebetween for seating engagement against the inside rounded corner of the slot, the included angle between a pair of intersecting planes containing at least portions of said surfaces of the sear being less than the included angle between a pair of intersecting planes containing at least portions of said surfaces of the slots; and (d) means for retaining the sears in the slots while allowing rocking thereof.

11. The chuck of claim 10, wherein the sear retaining means includes an elastic O-ring which is positioned in a circumferential groove which is formed in the hub and an aligned groove that is formed cross-wise in the first leg of each of the sears, the retainer means further including a rollpin extending transversely through the first leg of each sear into adjacent wing-like lateral extensions of each of the slots and, secondly, a plurality of retainer pins extending longitudinally in the hub through the wing-like lateral extensions for coacting with opposing ends of the rollpin of each sear to restrict radial movement of the sears outwardly of the slots.

* * * * *